US011873593B2

(12) United States Patent
Wei

(10) Patent No.: US 11,873,593 B2
(45) Date of Patent: Jan. 16, 2024

(54) WEAVING MACHINE HAVING YARN DYEING FUNCTION

(71) Applicant: Fu-Hua Pai, New Taipei (TW)

(72) Inventor: Hong-Ming Wei, Guiyang (CN)

(73) Assignee: Fu-Hua Pai, New Taipei (TW)

( * ) Notice: Subject to any disclaimer, the term of this patent is extended or adjusted under 35 U.S.C. 154(b) by 471 days.

(21) Appl. No.: 17/133,833

(22) Filed: Dec. 24, 2020

(65) Prior Publication Data

US 2021/0198827 A1 Jul. 1, 2021

(30) Foreign Application Priority Data

Dec. 31, 2019 (CN) ..... 201911415261.9
Dec. 31, 2019 (CN) ..... 201922500370.2

(51) Int. Cl.

| | |
|---|---|
| ***D06B 1/14*** | (2006.01) |
| ***D03D 15/65*** | (2021.01) |
| ***D03J 1/02*** | (2006.01) |
| ***D06B 11/00*** | (2006.01) |
| ***D06B 23/00*** | (2006.01) |
| ***D06B 23/10*** | (2006.01) |

(52) U.S. Cl.

CPC ..... *D06B 1/14* (2013.01); *D03D 15/65* (2021.01); *D03J 1/02* (2013.01); *D06B 11/002* (2013.01); *D06B 23/00* (2013.01); *D06B 23/10* (2013.01); *D06B 2700/02* (2013.01); *D06B 2700/06* (2013.01); *D06B 2700/35* (2013.01); *D06B 2700/36* (2013.01)

(58) Field of Classification Search

CPC ..... D06B 1/14; D06B 11/002; D06B 23/00; D06B 23/10; D06B 2700/02; D06B 2700/06; D06B 2700/35; D06B 2700/36; D03D 15/65; D03J 1/02

See application file for complete search history.

(56) References Cited

U.S. PATENT DOCUMENTS 3,508,421 A * 4/1970 Brawer ..... D06B 11/003 68/19
4,614,096 A * 9/1986 Beretta ..... D06B 3/16 68/184
5,458,160 A * 10/1995 Geiger ..... D03D 39/22 139/102

FOREIGN PATENT DOCUMENTS

IT 201900005592 A1 * 10/2020 ..... B41F 16/02

* cited by examiner

*Primary Examiner* — Khoa D Huynh
*Assistant Examiner* — Erick I Lopez
(74) *Attorney, Agent, or Firm* — Rosenberg, Klein & Lee

(57) ABSTRACT

A weaving machine includes a yarn winding mechanism for winding and unwinding undyed yarns, and a yarn coloring mechanism including a hot roller, inner and outer layer color paper tape winding devices for winding and unwinding inner and outer layer color paper tapes, respectively, and a packing paper winding device for winding and unwinding a packing paper. The inner and outer layer color paper tapes are configured to clamp therebetween the undyed yarns. A squeezing device includes a closed loop belt movably pressing the packing paper against the hot roller such that inks of the inner and outer layer color paper tapes are transferred to the undyed yarns. A back-end system is configured to weave or wind the dyed yarns.

16 Claims, 5 Drawing Sheets

WEAVING MACHINE HAVING YARN DYEING FUNCTION

CROSS-REFERENCE TO RELATED APPLICATION

This application claims priority of Chinese Patent Application Nos. 201922500370.2 and 201911415261.9, both filed on Dec. 31, 2019.

FIELD

The disclosure relates to a weaving machine having a yarn dyeing function.

BACKGROUND

A conventional yarn is stored in a bobbin, warp beam, or other yarn storage device before it is dyed. If a yarn needs to be stored after water dyeing, the yarn must be dried before it can be stored, which is time-consuming. In traditional yarn dyeing, the yarn is immersed in a solution containing dye, a large amount of inorganic salt is added to promote the dyeing, and then it is heated and washed with water to complete the dyeing. This kind of traditional yarn dyeing will use a lot of water during operation, and the utilization rate of the dye is low. Further, it will also produce waste water and exhaust gas, which is a waste of resources and is not environmentally friendly.

A cheese dyeing machine, as disclosed in Chinese Patent No. 104452141A, includes a dyeing tank, a creel disposed in the dyeing tank for holding a plurality of cheeses, a liquid storage tank communicating with the dyeing tank, and a liquid adding pump for sending dye solution in the liquid storage tank to the dyeing tank and for allowing the dye solution to squirt out of the creel, to pass through the cheeses and flow back to the liquid storage tank. Through this, the cheeses are dyed. Although the amount of the dye solution can be reduced, the utilization rate of the dye is still low, and the resources are still wasted.

SUMMARY

Therefore, an object of the present disclosure is to provide a weaving machine that has a yarn dyeing function and that is capable of alleviating at least one of the drawbacks of the prior art.

According to the present disclosure, a weaving machine comprises a yarn winding mechanism for winding and unwinding undyed yarns, a yarn coloring mechanism for receiving and dyeing the undyed yarns, and a back-end system. The yarn coloring mechanism includes a hot roller, an inner layer color paper tape winding device for unwinding an inner layer color paper tape from one end thereof to be wound to the other end thereof after looping over the hot roller, an outer layer color paper tape winding device for unwinding an outer layer color paper tape from one end of the outer layer color paper tape winding device to be wound to the other end of the outer layer color paper tape winding device after looping over the hot roller, a packing paper winding device for unwinding a packing paper from one end of the packing paper winding device to be wound to the other end of the packing paper winding device after looping over the hot roller, and a squeezing device.

The inner layer color paper tape movably abuts against an outer surface of the hot roller and is configured to be pressed by the undyed yarns. The outer layer color paper tape is configured to movably abut against the undyed yarns. The inner and outer layer color paper tapes are configured to clamp therebetween the undyed yarns. The packing paper movably abuts against the outer layer color paper tape. The squeezing device includes a closed loop belt movably pressing the packing paper against the hot roller such that inks of the inner and outer layer color paper tapes are transferred to the undyed yarns for dyeing the undyed yarns. The back-end system is configured to receive the dyed yarns and configured to weave or wind the dyed yarns.

BRIEF DESCRIPTION OF THE DRAWINGS

Other features and advantages of the present disclosure will become apparent in the following detailed description of the embodiments with reference to the accompanying drawings, of which.

DETAILED DESCRIPTION

Figure 1:
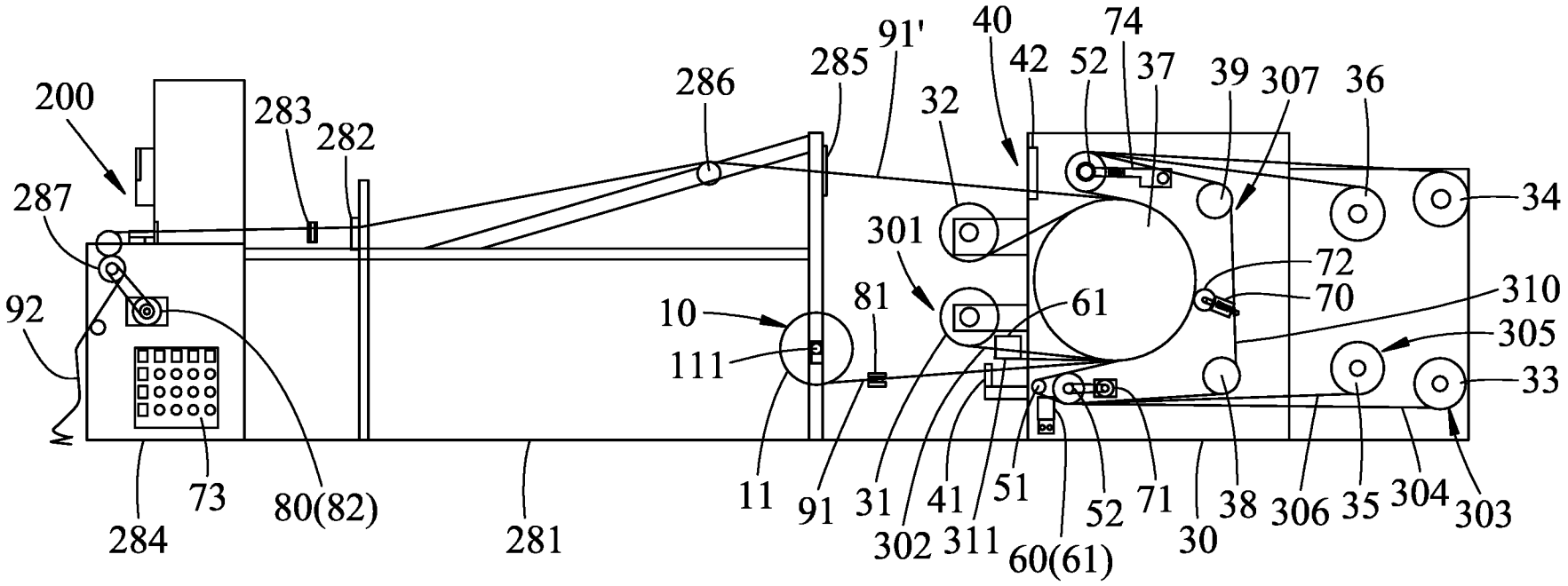
FIG. 1 is a schematic view of a weaving machine according to the first embodiment of the present disclosure.

Before the present disclosure is described in greater detail with reference to the accompanying embodiments, it should be noted herein that like elements are denoted by the same reference numerals throughout the disclosure.

Referring to FIG. 1, a weaving machine according to the first embodiment of the present disclosure is shown to include a yarn winding mechanism 10, a yarn coloring mechanism 30, a back-end system 200, and a yarn arrangement automatic control unit 40.

The yarn winding mechanism 10 is used for winding and unwinding a plurality of undyed yarns 91. In this embodiment, the yarn winding mechanism 10 includes a yarn winder 11 for winding and unwinding the undyed yarns 91, and an unwinding tension control system 111 connected to the yarn winder 11. The unwinding tension control system 111 uses an electromagnetic principle to change an axis distance of the yarn winder 11 to thereby control the tension of the undyed yarns 91 during feeding.

The yarn coloring mechanism 30 is used for receiving and dyeing the undyed yarns 91 unwound from the yarn winder 11, and includes a hot roller 37, an inner layer color paper tape winding device 301, an outer layer color paper tape winding device 303, a packing paper winding device 305, a squeezing device 307, two pressurized separating shafts 52, and a positioning roller 51.

The hot roller 37 is located rearwardly of the yarn winder 11 and is used for heating. The inner layer color paper tape winding device 301 and the outer layer color paper tape winding device 303 are respectively disposed on front and rear sides of the hot roller 37. The inner layer color paper tape winding device 301 includes an inner layer color paper tape unwinding reel 31, a positioning plate 311 located between the inner layer color paper tape unwinding reel 31 and the hot roller 37, an inner layer color paper tape winding reel 32 spaced apart from the inner layer color paper tape unwinding reel 31 in a top-bottom direction, and an inner layer color paper tape 302 wound on the inner layer color paper tape unwinding reel 31. The inner layer color paper tape 302 is unwound from the inner layer color paper tape unwinding reel 31, passes along the positioning plate 311, is looped over the hot roller 37, and is wound on the inner layer color paper tape winding reel 32. Through this, the inner layer color paper tape 302 movably abuts against an outer surface of the hot roller 37. The undyed yarns 91 are unwound from the yarn winder 11, are looped over the hot roller 37, and are pressed against an outer surface of the inner layer color paper tape 302.

The outer layer color paper tape winding device 303 includes an outer layer color paper tape unwinding reel 33, an outer layer color paper tape winding reel 34 spaced apart from the outer layer color paper tape unwinding reel 33 in the top-bottom direction, and an outer layer color paper tape 304 wound on the outer layer color paper tape unwinding reel 33. The outer layer color paper tape 304 is unwound from the outer layer color paper tape unwinding reel 33, is looped over the hot roller 37, and is wound on the outer layer color paper tape winding reel 34. The outer layer color paper tape 304 movably abuts against the undyed yarns 91, so that the undyed yarns 91 are clamped between the inner layer color paper tape 302 and the outer layer color paper tape 304.

The packing paper winding device 305 is disposed between the outer layer color paper tape winding device 303 and the hot roller 37, and includes a packing paper unwinding reel 35, a packing paper winding reel 36 spaced apart from the packing paper unwinding reel 35 in the top-bottom direction, and a packing paper 306 wound on the packing paper unwinding reel 35. The packing paper 306 is unwound from the packing paper unwinding reel 35, is looped over the hot roller 37, and is wound on the packing paper winding reel 36. The packing paper 306 movably abuts against the outer layer color paper tape 304 at a side opposite to the inner layer color paper tape 302.

In this embodiment, the inner layer color paper tape 302 and the outer layer color paper tape 304 are dyed with color using a printer (not shown).

The squeezing device 307 includes an offset shaft 38 located below and rearward of the hot roller 37, a support shaft 39 spaced apart from the offset shaft 38 in the top-bottom direction, and a closed loop belt 310 made of a special material that can withstand high temperature, such as high temperature felt.

The pressurized separating shafts 52 are disposed movably and respectively on top and bottom sides of the hot roller 37, and are provided for looping over of the closed loop belt 310, the packing paper 306 and the outer layer color paper tape 304.

The positioning roller 51 can rotate about its own axis, and is proximate to a lower one of the pressurized separating shafts 52. The positioning roller 51 is provided for looping over of the closed loop belt 310, the packing paper 306 and the outer layer color paper tape 304, and is used for feeding the packing paper 306 and the outer layer color paper tape 304.

Thus, the closed loop belt 310 is looped around the offset shaft 38, the lower one of the pressurized separating shafts 52, the positioning roller 51, an upper one of the pressured separating shafts 52 and the support shaft 39.

By moving the pressurized separating shafts 52 toward the hot roller 37, the closed loop belt 310 can abut tightly against the hot roller 37 to movably press the packing paper 306 against the hot roller 37, so that the inner and outer layer color paper tapes 302, 304 tightly clamp therebetween the undyed yarns 91. Under the action of the high temperature of the hot roller 37, inks of the inner and outer layer color paper tapes 302, 304 are sublimated, transferred to and printed on the undyed yarns 91 for dyeing the undyed yarns 91. During transferring and printing of the dyeing process, the packing paper 306 is clamped between the closed loop belt 310 and the outer layer color paper tape 304 to prevent the closed loop belt 310 from being stained by the outer layer color paper tape 301 so as to remain clean.

Preferably, the yarn coloring mechanism 30 further includes a color tape positioning system 60 and an automatic pressure detection system 70. The color tape positioning system 60 selects a width of the paper feed positioning plate 311 according to the width of the color tape, and includes two side positioners 61 each of which is used for aligning a corresponding one of the inner and outer layer color paper tapes 302, 304 with the undyed yarns 91 to ensure the accuracy of dyeing.

The automatic pressure detection system 70 is used for detecting yarn speed. Through the yarn speed, transmission lengths and tension values of the yarns 91 can be obtained to adjust the pressure of the closed loop belt 310 on the hot roller 37, so that the tensions of the yarns 91 remain unchanged. The automatic pressure detection system 70 includes a belt pressure control device 71 for adjusting the pressure of the closed loop belt 310 on the hot roller 37, a yarn tension detection shaft 72, an electrical control device 73, and a pressure detector 74 connected to the upper one of the pressurized separating shafts 52. The yarn tension detection shaft 72 detects the tension values of the yarns 91, and then transmits the tension values to the electrical control device 73. The electrical control device 73 calculates and obtains a predetermined pressure value based on the tension values received from the yarn tension detection shaft 72. The pressure detector 74 detects an actual pressure value of the closed loop belt 310 on the hot roller 37. The belt pressure control device 71 is used to move the pressurized separating shafts 52 toward or away from the hot roller 37 to tighten or loosen the closed loop belt 310, so that the actual pressure value of the closed loop belt 310 on the hot roller 37 is adjusted to equal the predetermined pressure value, and so that the tensions of the yarns 91 remain unchanged.

The back-end system 200 is used for receiving the dyed yarns 91' exiting the yarn coloring mechanism 30. In this embodiment, the back-end system 200 is disposed forwardly of the yarn coloring mechanism 30, and is configured as a woven mechanism for weaving the dyed yarns 91' into a colored webbing 92. The back-end system 200 includes a base frame 281, a fixed steel reed 282, a warp stop motion 283, a weaving unit 284, and a synchronous control device 80. The base frame 281 is provided for the yarn winder 11 to be disposed thereon. Preferably, a yarn guide reed 285 and a yarn adjustment shaft 286 are further provided between the yarn coloring mechanism 30 and the back-end system 200. After the dyed yarns 91' are drawn out of the yarn coloring mechanism 30, they are then sequentially passed through the yarn guide reed 285, the yarn adjustment shaft 286, the fixed steel reed 282 and the warp stop motion 283 before being introduced into the weaving unit 284. The weaving unit 284 is used for weaving the dyed yarns 91' into the colored webbing 92. The weaving unit 284 uses a drive system 287 to drive the webbing 92 out of the back-end system 200 for storage.

The synchronous control device 80 is used for coordinating the feeding speed, and includes an optical encoder 81 proximate to the yarn winder 11, and a stepping motor 82 mounted on the weaving unit 284. The optical encoder 81 detects a feeding speed of the yarns 91, and transmits the feeding speed to the stepping motor 82. By changing a rotational speed of the stepping motor 82, speed of the yarns 91' entering the weaving unit 284 can be adjusted to be the same as the speed of the yarns 91 entering the yarn coloring mechanism 30. When the weaving unit 284 is stopped, the yarn coloring mechanism 30 is also stopped, and the pressurized separating shafts 52 are moved away from the hot roller 37 to loosen the closed loop belt 310 and will not generate pressure on the yarns 91, 91'. Simultaneously, the hot roller 37 cools down to prevent the undyed yarns 91 from aging or melting due to prolonged exposure to high temperature.

The yarn arrangement automatic control unit 40 includes a first yarn arrangement reed 41 and a second yarn arrangement reed 42. The first yarn arrangement reed 41 is movably disposed between the yarn winder 11 and the hot roller 37 for separating the undyed yarns 91 and for permitting the same to pass regularly therethrough. The second yarn arrangement reed 42 is movably disposed between the hot roller 37 and the yarn guide reed 285 for separating the dyed yarns 91' and for permitting the same to pass regularly therethrough. Through the provision of the first and second yarn arrangement reeds 41, 42, the undyed yarns 91 and the dyed yarns 91' can be uniformly arranged and can be prevented from interlacing.

This disclosure uses the water-free dyeing technology of sublimation transfer printing, and the undyed yarns 91 are dyed through the yarn coloring mechanism 30, so that wasting of water resources can be avoided, and there is no need to treat waste water. Further, in this embodiment, the dyed yarns 91' are directly sent to the weaving unit 284 so as to be woven into the webbing 92. The yarn dyeing and webbing weaving processes are vertically integrated into a consistent operation, so that not only the problem of water pollution can be avoided, but also the time of replacing colored yarns can also be saved, and the amount of colored yarns can be reduced. Hence, in the first embodiment, the production processes can be simplified, the production costs can be reduced and the production efficiency can be improved.

Figure 2:
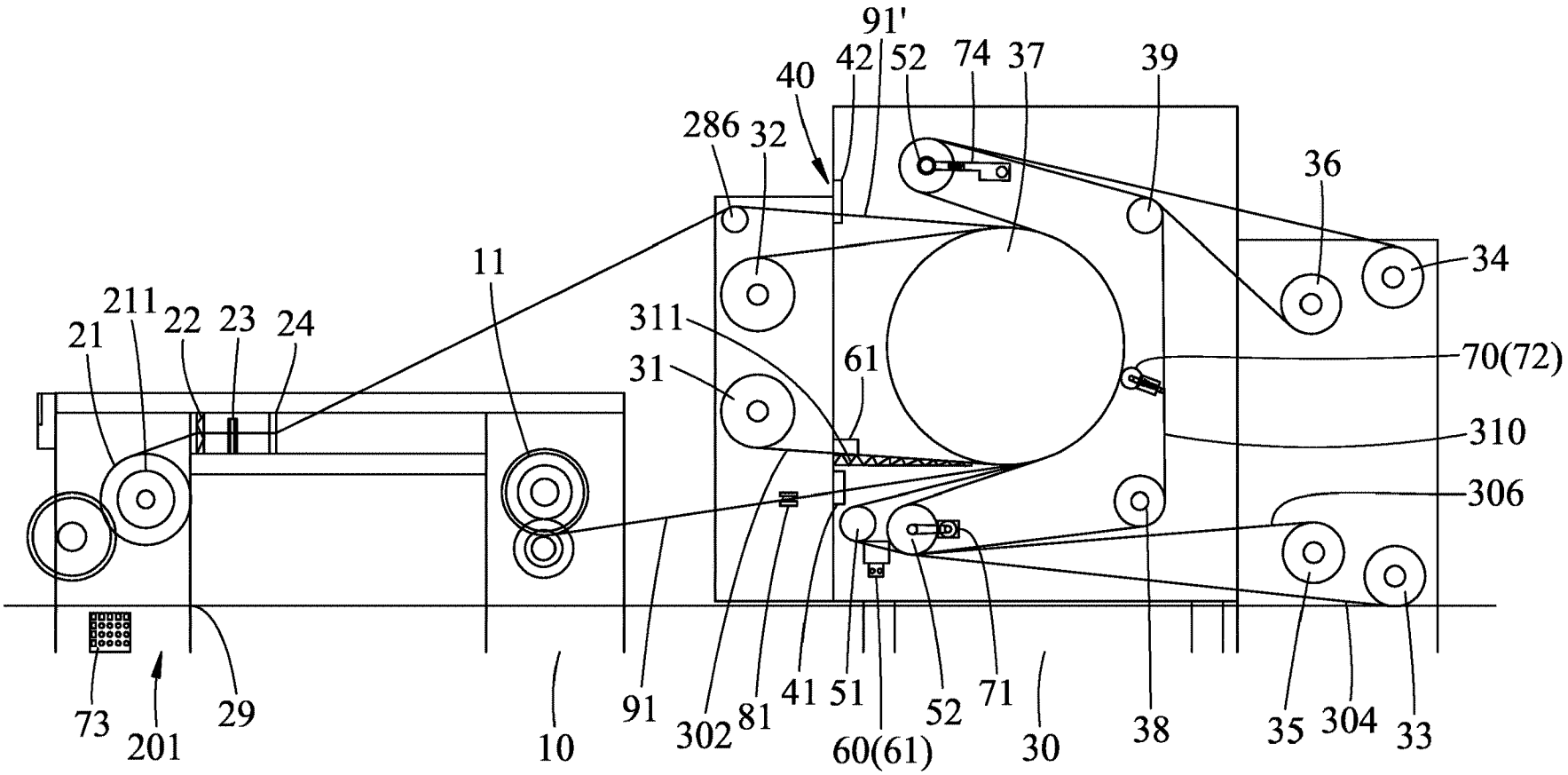
FIG. 2 is a schematic view of a weaving machine according to the second embodiment of the present disclosure.

Referring to FIG. 2, a weaving machine according to the second embodiment of the present disclosure is shown to be similar to the first embodiment, but differs in the structure of the back-end system 201. In the second embodiment, the back-end system 201 is a winding mechanism for winding the dyed yarns 91', and includes a support frame 29, a colored yarn winder 21 rotatably disposed on the support frame 29, and a steel reed 24, a warp stop motion 23 and an adjustable reed 22 sequentially arranged on the support frame 29. After the dyed yarns 91' sequentially pass through the yarn arrangement reed 42, the yarn adjustment shaft 286, the steel reed 24, the warp stop motion 23 and the adjustable reed 22, they are wound on the colored yarn reed 21.

The back-end system 201 further includes a yarn-winding tension control system 211 for controlling the tension of the dyed yarns 91' during winding, and a drive system (not shown) for driving the colored yarn winder 21 to rotate so as wind the dyed yarns 91'.

The second embodiment similarly uses the water-free dyeing technology of sublimation transfer printing to dye the undyed yarns 91, so that wasting of water resources can be avoided, and there is no need to treat waste water. Simultaneously, with the colored yarn winder 21 winding the dyed yarns 91', there is no need to re-guide the yarns 91', so that the production process can be simplified and the production time can be saved.

Figure 3:
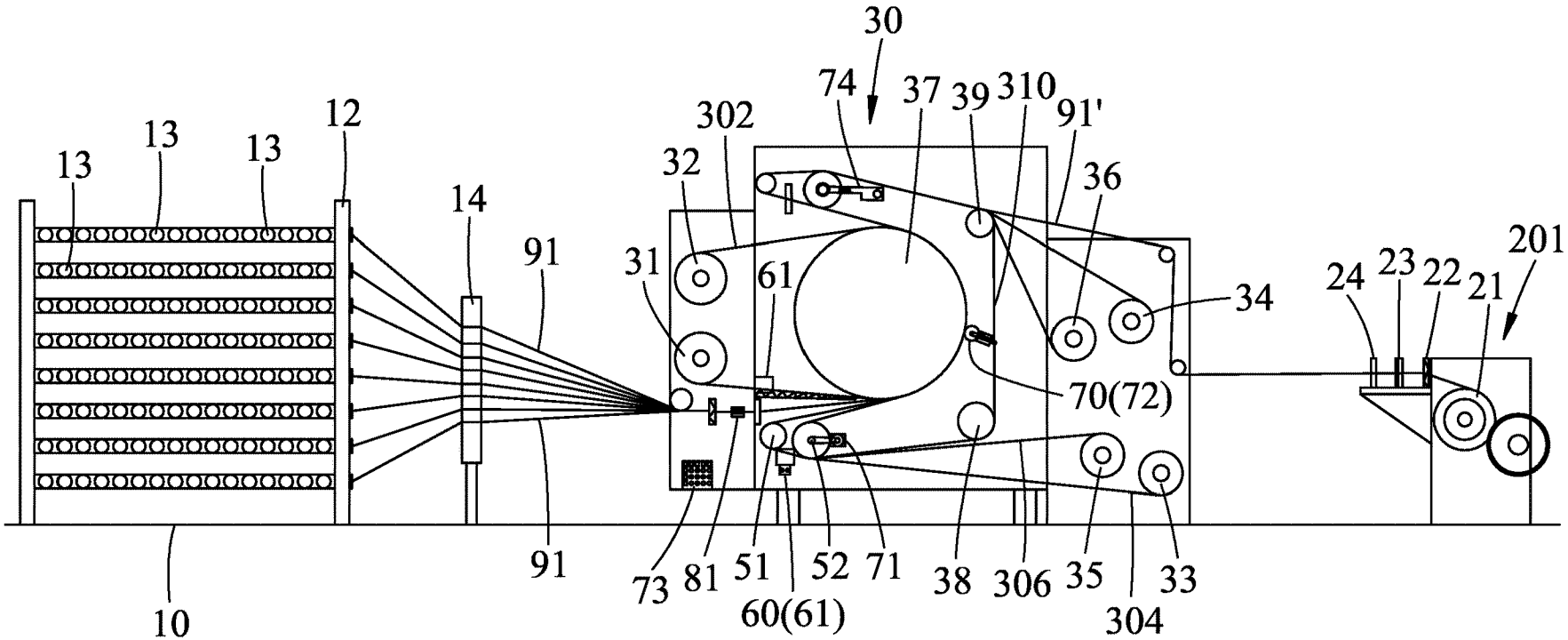
FIG. 3 is a schematic view of a weaving machine according to the third embodiment of the present disclosure.

Referring to FIG. 3, a weaving machine according to the third embodiment of the present disclosure is shown to be similar to the second embodiment, but differs in that, in the third embodiment, the back-end system 201 is disposed rearwardly of the yarn coloring mechanism 30. Further, the yarn winding mechanism 10 uses bobbins for feeding the undyed yarns 91, and includes a bobbin creel 12, a plurality of bobbins 13 regularly arranged on the bobbin creel 12 for winding and unwinding the undyed yarns 91, and a yarn guide 14 located between the bobbin creel 12 and the yarn coloring mechanism 30.

When the undyed yarns 91 are unwound from the respective bobbins 13, they pass through the yarn guide 14 and are guided by the same to the yarn coloring mechanism 30. The dyed yarns 91' are wound on the colored yarn winder 21 of the back-end system 201 after exiting from the yarn coloring mechanism 30. The third embodiment has the same effect as the second embodiment.

Figure 4:
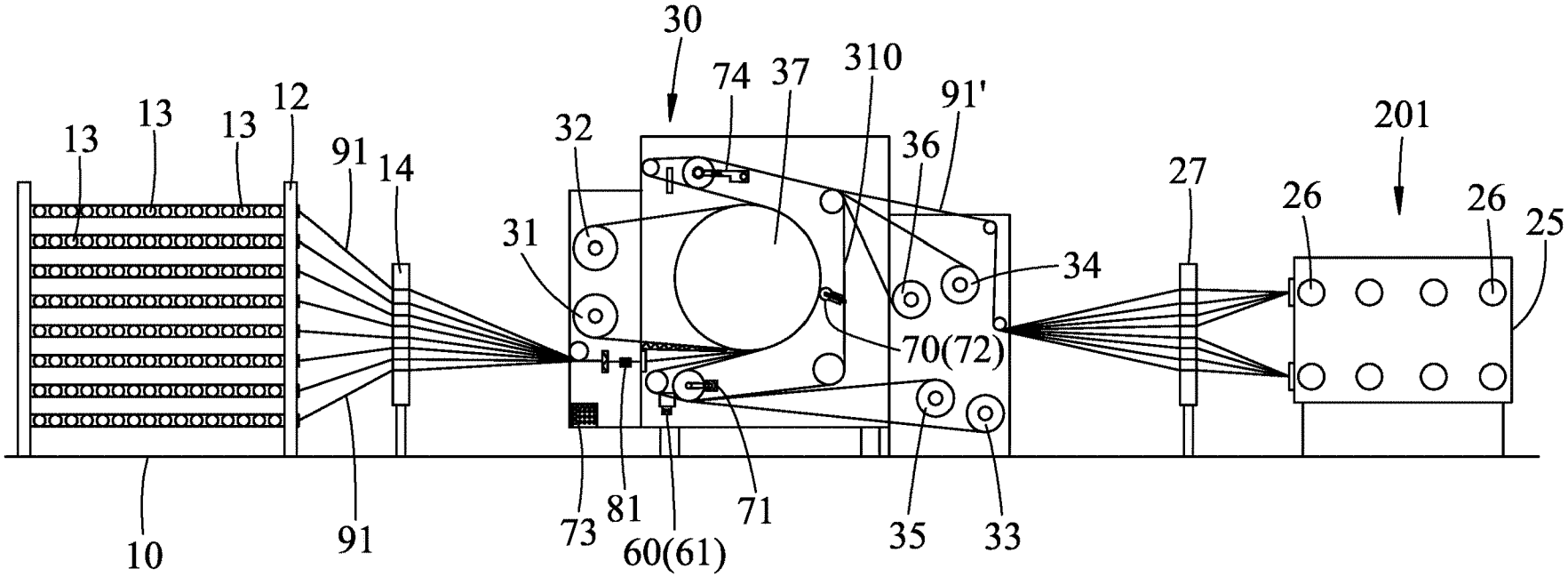
FIG. 4 is a schematic view of a weaving machine according to the fourth embodiment of the present disclosure.

Referring to FIG. 4, a weaving machine according to the fourth embodiment of the present disclosure is shown to be similar to the third embodiment, but differs in that the back-end system 201 of the fourth embodiment uses bobbins for receiving the dyed yarns 91', and includes a splitting machine 25, a plurality of bobbins 26 regularly arranged on the splitting machine 25, and a yarn guide 27 located between the splitting machine 25 and the yarn coloring mechanism 30.

After the dyed yarns 91' exit from the yarn coloring mechanism 30, they pass through the yarn guide 27 and are guided by the same to be wound on the respective bobbins 26. The fourth embodiment has the same effect as the third embodiment.

Figure 5:
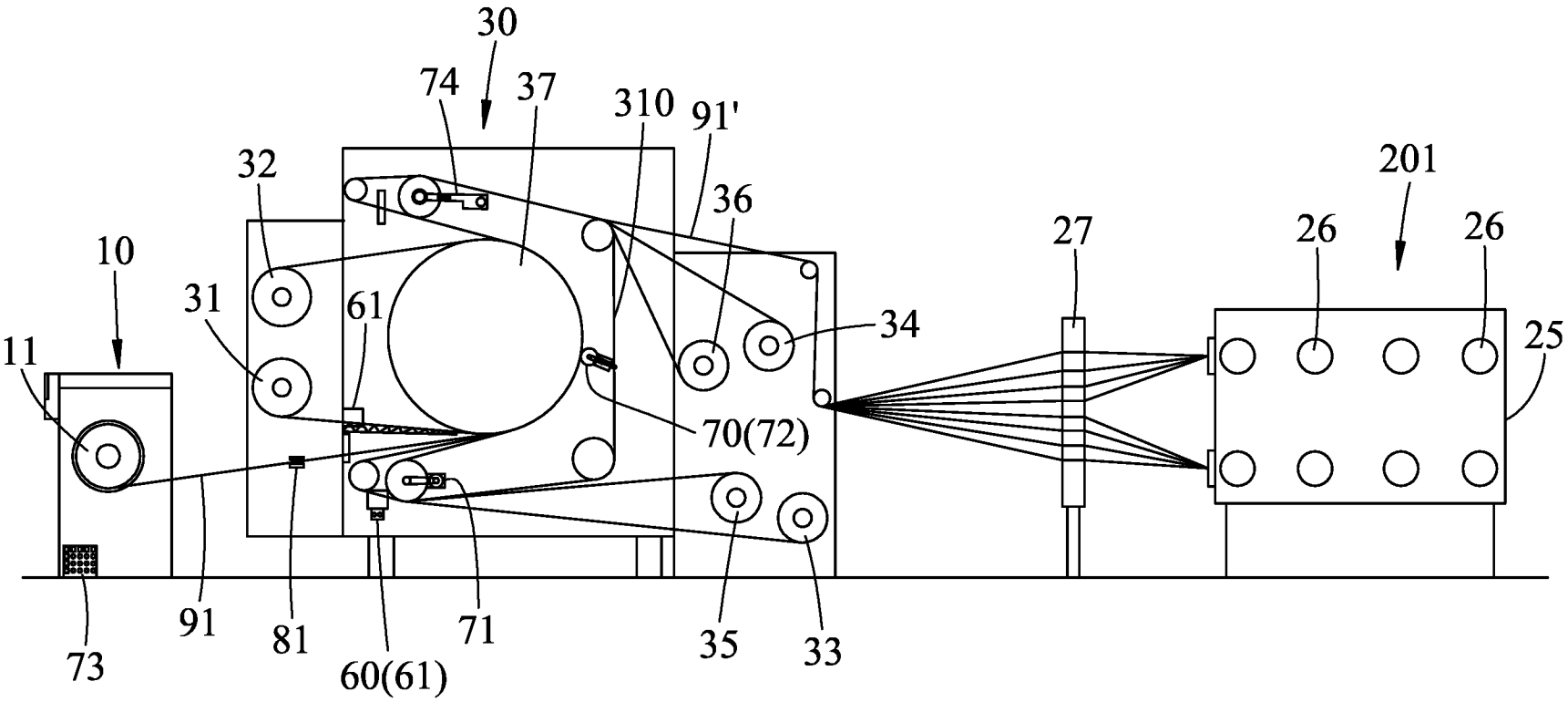
FIG. 5 is a schematic view of a variation of the weaving machine of the present disclosure.

FIG. 5 illustrates a variation of this disclosure. As shown, the yarn winding mechanism 10 uses the yarn winder 11 for feeding the undyed yarns 91, and the back-end system 201 uses the bobbins 26 for receiving the dyed yarns 91'. This variation also has the effect of winding and receiving the dyed yarns 91'.

From the aforesaid embodiments, it is apparent that this disclosure uses any combination of winder and bobbins for feeding the undyed yarns 91 or for receiving the dyed yarns 91'.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A weaving machine comprising:

a yarn winding mechanism for winding and unwinding undyed yarns;

a yarn coloring mechanism for receiving the undyed yarns and for dyeing the undyed yarns using a water-free dyeing technology of sublimation transfer printing, said yarn coloring mechanism including:

a hot roller, an inner layer color paper tape winding device for unwinding an inner layer color paper tape from one end thereof to be wound to the other end thereof after looping over said hot roller, said inner layer color paper tape movably abutting against an outer surface of said hot roller and being configured to be pressed by the undyed yarns, an outer layer color paper tape winding device for unwinding an outer layer color paper tape from one end of said outer layer color paper tape winding device to be wound to the other end of said outer layer color paper tape winding device after looping over said hot roller, said outer layer color paper tape being configured to movably abut against the undyed yarns, said inner layer color paper tape and said outer layer color paper tape being configured to clamp therebetween the undyed yarns, a packing paper winding device for unwinding a packing paper from one end of said packing paper winding device to be wound to the other end of said packing paper winding device after looping over said hot roller, said packing paper movably abutting against said outer layer color paper tape, and a squeezing device including a closed loop belt movably pressing said packing paper against said hot roller such that inks carried by each of said inner layer color paper tape and said outer layer color paper tape are sublimated by heat of the hot roller and transferred to the undyed yarns and thereby dye the undyed yarns; and a back-end system configured to receive the dyed yarns and configured to weave or wind the dyed yarns.

2. The weaving machine as claimed in claim 1, wherein said back-end system is configured to weave the dyed yarns into a webbing.

3. The weaving machine as claimed in claim 2, wherein said back-end system includes a fixed steel reed and a warp stop motion that are configured for passing of the dyed yarns sequentially therethrough, and a weaving unit that is configured for receiving the dyed yarns exiting from said warp stop motion and for weaving the dyed yarns into the webbing.

4. The weaving machine as claimed in claim 3, wherein said back-end system further includes a synchronous control device, said synchronous control device including an optical encoder proximate to said yarn winding mechanism, and a stepping motor mounted on said weaving unit, said optical encoder being configured for detecting a feeding speed of the undyed yarns and transmitting the detected feeding speed to said stepping motor for adjusting the feeding speed of the undyed yarns.

5. The weaving machine as claimed in claim 1, further comprising a yarn arrangement automatic control unit which includes a first yarn arrangement reed for separating the undyed yarns and for permitting the undyed yarns to regularly pass therethrough, and a second yarn arrangement reed for separating the dyed yarns and for permitting the dyed yarns to regularly pass therethrough.

6. The weaving machine as claimed in claim 1, wherein said back-end system is configured to wind the dyed yarns.

7. The weaving machine as claimed in claim 6, wherein said back-end system includes at least one colored yarn winder for winding the dyed yarns.

8. The weaving machine as claimed in claim 7, wherein said back-end system further includes a steel reed, a warp stop motion and an adjustable reed that are configured for the dyed yarns to pass sequentially therethrough so as to be wound on said colored yarn winder.

9. The weaving machine as claimed in claim 6, wherein said back-end system includes a plurality of bobbins configured for respectively winding the dyed yarns.

10. The weaving machine as claimed in claim 9, wherein said back-end system further includes a yarn guide that is located between said yarn coloring mechanism and said bobbins and that is configured for passing of the dyed yarns therethrough and for guiding the dyed yarns to said bobbins, respectively.

11. The weaving machine as claimed in claim 1, wherein said yarn winding mechanism includes a yarn winder for winding and unwinding the undyed yarns.

12. The weaving machine as claimed in claim 1, wherein said yarn winding mechanism includes a plurality of bobbins for respectively winding and unwinding the undyed yarns.

13. The weaving machine as claimed in claim 12, wherein said yarn winding mechanism further includes a yarn guide located between said yarn coloring mechanism and said bobbins for passing of the undyed yarns therethrough and for guiding the undyed yarns to said yarn coloring mechanism.

14. The weaving machine as claimed in claim 1, wherein said yarn coloring mechanism further includes two pressurized separating shafts disposed movably and respectively on two opposite sides of said hot roller, and a positioning roller proximate to one of said pressurized separating shafts, said pressurized separating shafts being provided for looping over of said closed loop belt, said packing paper and said outer layer color paper tape, said positioning roller being rotatable about its own axis and being provided for looping over of said closed loop belt, said packing paper and said outer layer color paper tape.

15. The weaving machine as claimed in claim 1, wherein said yarn coloring mechanism further includes an automatic pressure detection system, said automatic pressure detection system including a yarn tension detection shaft for detecting tension values of the undyed yarns, an electrical control device for calculating and obtaining a predetermined pressure value based on the tension values received from said yarn tension detection shaft, a pressure detector for detecting an actual pressure value of said closed loop belt on said hot roller, and a belt pressure control device for adjusting a pressure of said closed loop belt on said hot roller.

16. The weaving machine as claimed in claim 1, wherein said yarn coloring mechanism further includes a color tape positioning system, said color tape positioning system including two side positioners each of which is used for aligning a corresponding one of said inner layer color paper tape and said outer layer color paper tape with the undyed yarns.

* * * * *